US010171191B2

(12) United States Patent
Terashima et al.

(10) Patent No.: US 10,171,191 B2
(45) Date of Patent: Jan. 1, 2019

(54) BROADCAST RECEIVING APPARATUS AND BROADCAST RECEIVING METHOD

(71) Applicant: FUJITSU TEN LIMITED, Kobe-shi, Hyogo (JP)

(72) Inventors: Yuya Terashima, Kobe (JP); Kenichi Nakano, Kobe (JP)

(73) Assignee: DENSO TEN Limited, Kobe (JP)

( * ) Notice: Subject to any disclaimer, the term of this patent is extended or adjusted under 35 U.S.C. 154(b) by 18 days.

(21) Appl. No.: 15/725,427

(22) Filed: Oct. 5, 2017

(65) Prior Publication Data

US 2018/0109340 A1 Apr. 19, 2018

(30) Foreign Application Priority Data

Oct. 14, 2016 (JP) ..... 2016-202910

(51) Int. Cl.

| | |
|---|---|
| ***H04H 20/10*** | (2008.01) |
| ***H04H 20/08*** | (2008.01) |
| ***H04H 20/30*** | (2008.01) |
| ***H04H 20/47*** | (2008.01) |

(52) U.S. Cl.

CPC ..... *H04H 20/106* (2013.01); *H04H 20/08* (2013.01); *H04H 20/30* (2013.01); *H04H 20/47* (2013.01)

(58) Field of Classification Search

CPC ..... H04H 20/106; H04H 20/08; H04H 20/03; H04H 20/47

See application file for complete search history.

(56) References Cited

U.S. PATENT DOCUMENTS

2007/0293167 A1* 12/2007 Shridhar ..... H04H 40/18 455/130

2011/0305301 A1* 12/2011 Mino ..... H04B 1/1027 375/316

FOREIGN PATENT DOCUMENTS

JP 2012-004750 A 1/2012

* cited by examiner

*Primary Examiner* — Sonia L Gay

(74) *Attorney, Agent, or Firm* — Oliff PLC

(57) ABSTRACT

A broadcast receiving apparatus includes a reception unit, sound controlling unit, and determination unit. The reception unit receives a signal of an analog broadcast and a signal of a digital broadcast having the same broadcast content. The sound controlling unit performs, when an output of the broadcast receiving apparatus switched into the analog broadcast from the digital broadcast, a switching control of switching the output into the analog broadcast from the digital broadcast so that an acoustic characteristic of the output digital broadcast gradually approaches an acoustic characteristic of the analog broadcast based on a reception intensity of the signal of the analog broadcast. The determination unit determines, after the sound controlling unit starts the switching control, whether or not the switching control performed by the sound controlling unit is to be continued, based on reception state of the signal of the digital broadcast.

10 Claims, 5 Drawing Sheets

BROADCAST RECEIVING APPARATUS AND BROADCAST RECEIVING METHOD

CROSS-REFERENCE TO RELATED APPLICATION

This application is based upon and claims the benefit of priority of the prior Japanese Patent Application No. 2016-202910, filed on Oct. 14, 2016, the entire contents of which are incorporated herein by reference.

FIELD

The embodiment discussed herein is directed to a broadcast receiving apparatus and a broadcast receiving method.

BACKGROUND

Conventionally, there exists a broadcast receiving apparatus that simultaneously receives a digital broadcast and an analog broadcast having the same broadcast contents broadcasted in an In Band On Channel (IBOC) system. Even when the digital broadcast and the analog broadcast have the same broadcast contents, there exists a difference between their acoustic characteristics. Moreover, when a reception state of the digital broadcast becomes worse, the broadcast receiving apparatus switches an outputting broadcast from the digital broadcast into the analog broadcast.

Thus, there exists a broadcast receiving apparatus that gradually brings, when one of the digital broadcast and the analog broadcast is switched into the other, an acoustic characteristic of the one broadcast close to that of the other broadcast (see Japanese Laid-open Patent Publication No. 2012-004750, for example).

However, in the conventional technology, a switching control between acoustic characteristics is not sufficient, which is for bringing an acoustic characteristic of one broadcast close to that of the other.

SUMMARY

A broadcast receiving apparatus according to the embodiment includes a reception unit, a sound controlling unit, and a determination unit. The reception unit receives a signal of an analog broadcast and a signal of a digital broadcast having the same broadcast content. The sound controlling unit performs, when an output of the broadcast receiving apparatus is switched into the analog broadcast from the digital broadcast, a switching control of switching the output into the analog broadcast from the digital broadcast so that an acoustic characteristic of the output digital broadcast gradually approaches an acoustic characteristic of the analog broadcast based on a reception intensity of the signal of the analog broadcast received by the reception unit. The determination unit determines, after the sound controlling unit starts the switching control, whether or not the switching control performed by the sound controlling unit is to be continued, based on a reception state of the signal of the digital broadcast received by the reception unit.

BRIEF DESCRIPTION OF DRAWINGS

A more complete appreciation of the present disclosure and many of the attendant advantages thereof will be readily obtained as the same becomes better understood by reference to the following detailed description when considered in connection with the accompanying drawings, wherein.

DESCRIPTION OF EMBODIMENT

Hereinafter, an exemplary embodiment of a broadcast receiving apparatus and a broadcast receiving method disclosed in the present application will be described in detail with reference to the accompanying drawings. The present disclosure is not limited to the following embodiment.

Hereinafter, a broadcast receiving apparatus and a broadcast receiving method will be explained, which simultaneously receive a digital broadcast and an analog broadcast including the same broadcast contents broadcasted in an In Band On Channel (IBOC) system.

Figure 1:
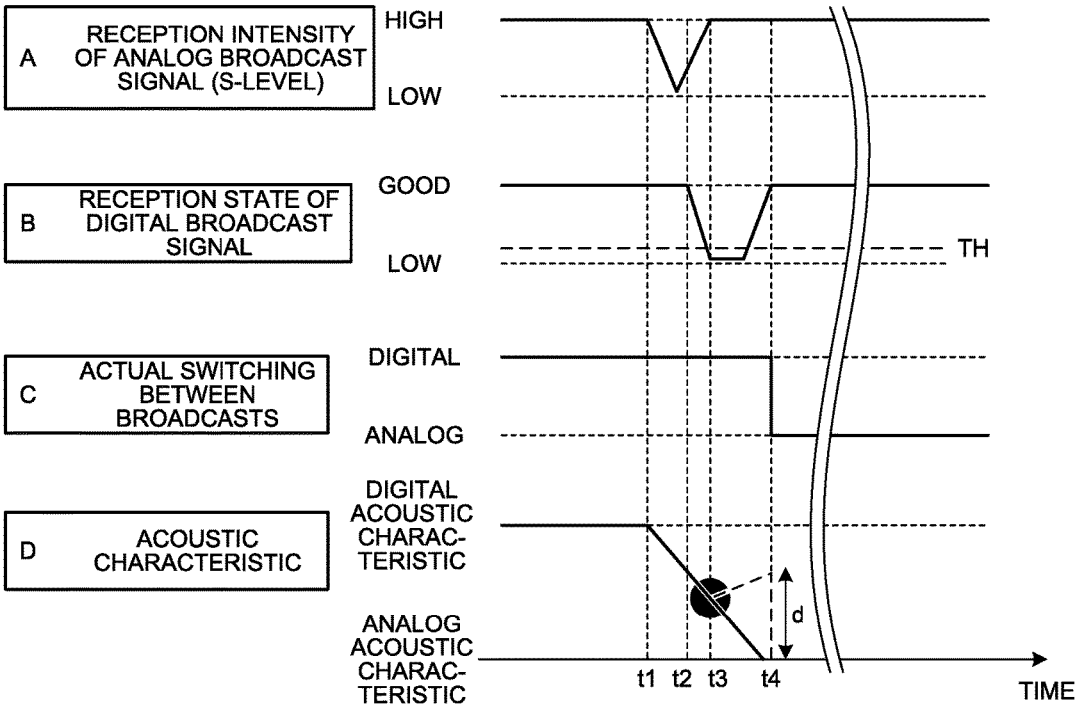
FIG. 1 is a diagram illustrating the outline of a broadcast receiving method.

First, the outline of the broadcast receiving method according to the embodiment will be explained with reference to FIG. 1. FIG. 1 is a diagram illustrating the outline of the broadcast receiving method. This broadcast receiving method is to be executed by the broadcast receiving apparatus to be mentioned later illustrated in FIG. 2.

Herein, as indicated by "A" illustrated in FIG. 1, it is assumed that, when the broadcast receiving apparatus outputs a digital broadcast, a reception intensity (hereinafter, may be referred to as "S-level") of a signal (hereinafter, may be referred to as "analog broadcast signal") of the received analog broadcast is reduced during an interval between time points t1 and t3.

In this case, as indicated by "B" illustrated in FIG. 1, a reception state of a signal (hereinafter, may be referred to as "digital broadcast signal") of the digital broadcast starts to be reduced from a time point t2 that is delayed from the time point t1 by a predetermined time interval when the S-level of the analog broadcast signal starts to reduce.

In this manner, the S-level of the analog broadcast signal changes in advance of the change in reception state of the digital broadcast signal. The broadcast receiving method according to the embodiment detects a Carrier-to-Noise ratio (C/N ratio) of the digital broadcast signal as the reception state, for example.

As described above, in the IBOC, even when contents of the digital broadcast and the analog broadcast are the same, there exists a difference between their acoustic characteristics. Specifically, a sound range of the acoustic characteristic of the digital broadcast is broader than that of the analog broadcast.

Thus, a digital broadcast is to be output in preference to an analog broadcast. However, there exists a case in some cases where a reception state of the digital broadcast signal becomes worse and the outputting broadcast is switched from the digital broadcast into the analog broadcast.

In a case of the switched analog broadcast, sound in a high frequency range is not output that was output in a case of the digital broadcast before the switching. Such a change in the acoustic characteristic may provide unpleasant feeling in human hearing sense to a user.

Thus, the switching control is performed that gradually brings, when an outputting broadcast is switched from a digital broadcast into an analog broadcast, the acoustic characteristic close to that of the analog broadcast from that of the digital broadcast so as to change the broadcast.

It is preferable that this switching control is performed by taking the longest time interval possible. This is because when the switching control is performed by taking a long time interval, the acoustic characteristic is changed more gradually compared with a case where the switching control is performed by taking a short time interval.

Therefore, the above conventional broadcast receiving apparatus performs the switching control over the acoustic characteristic on the basis of the S-level of the analog broadcast signal that is changed in advance of a reception state of the digital broadcast signal so that the time interval for the switching control is long.

However, the conventional broadcast receiving apparatus performs the switching control over the acoustic characteristic by following the S-level of the analog broadcast signal, and thus the switching control over the acoustic characteristic is not sufficient.

Specifically, as indicated by "A" illustrated in FIG. 1, when the S-level of the analog broadcast signal recovers in a short interval, as indicated by "D" illustrated in FIG. 1 by using a dashed line in an interval between the time point t3 and a time point t4, the switching control is performed so that the acoustic characteristic approaches that of the digital broadcast by following the recovery of the S-level of the analog broadcast signal.

Next, when the broadcast is switched, at the time point t4, from the digital broadcast into the analog broadcast by worsening of the reception state of the digital broadcast signal, for example, the acoustic characteristic is rapidly changed.

Specifically, the acoustic characteristic is rapidly changed at the time point t4 by an amount of a width "d" as indicated by "D" illustrated in FIG. 1. Therefore, unpleasant feeling in human hearing sense is provided to a user.

In this manner, the control of the conventional broadcast receiving apparatus over the acoustic characteristic is not sufficient, and thus the acoustic characteristic is rapidly changed in some cases before and after the switching between the broadcasts. This is because the switching control over the acoustic characteristic is performed on the basis of only the S-level of the analog broadcast signal.

Hence, the broadcast receiving method according to the embodiment performs the switching control over the acoustic characteristic on the basis of a reception state of the digital broadcast signal in addition to an S-level of the analog signal so as to improve accuracy in the switching control over the acoustic characteristic.

Specifically, the broadcast receiving method according to the embodiment first starts, similarly to the conventional technology, the switching control at the time point t1 on the basis of the S-level of the analog broadcast signal. Next, the broadcast receiving method according to the embodiment determines, on the basis of a reception state of the digital broadcast signal, whether or not the switching control is to be continued.

Specifically, as indicated by "B" illustrated in FIG. 1 by using the time point t3 and the following, the broadcast receiving method according to the embodiment determines that the switching control is to be continued when the reception state of the digital broadcast signal is lower than a reception-state threshold TH, for example.

The reception-state threshold TH indicates a threshold of the reception state at which a reception state of the digital broadcast signal is so worse that a digital broadcast signal is not able to be decoded by the broadcast receiving apparatus, for example. Therefore, when a reception state of the digital broadcast is lower than the reception-state threshold TH, the broadcast receiving apparatus is not able to output a digital broadcast in the near future.

In other words, the broadcast receiving method according to the embodiment predicts the necessity for switching of broadcast from a digital broadcast into an analog broadcast on the basis of a reception state of a digital broadcast signal, and determines that the above switching control is to be continued when the switching into the analog broadcast is predicted to be needed.

Next, the broadcast receiving apparatus according to the embodiment continues the switching control in accordance with the determination result so as to complete the switching control over the acoustic characteristic by the time point t4 (see "C" illustrated in FIG. 1) at which the broadcast is actually changed. Thus, as indicated by "D" illustrated in FIG. 1 by using a solid line, the switching control is able to be gradually performed by taking a long time interval.

In this manner, the broadcast receiving apparatus according to the embodiment starts the switching control from an acoustic characteristic of a digital broadcast into an acoustic characteristic of an analog broadcast on the basis of an S-level of the analog broadcast. Thus, the switching control is able to be started before a reception state of the digital broadcast signal becomes worse.

When starting the switching control, the broadcast receiving method according to the embodiment determines whether or not this switching control is to be continued, on the basis of not the S-level of the analog broadcast but the reception state of the digital broadcast signal. Thus, a rapid change in the acoustic characteristic is able to be suppressed when the broadcast is switched from the digital broadcast into the analog broadcast.

Therefore, by employing the broadcast receiving method according to the present embodiment, it is possible to improve accuracy in the switching control over the acoustic characteristic.

In the above example, the case is explained in which the switching control from the acoustic characteristic of the digital broadcast into the acoustic characteristic of the analog broadcast is performed, a case will be mentioned later with reference to FIG. 4 in which the switching control from the acoustic characteristic of the analog broadcast into the acoustic characteristic of the digital broadcast.

In the above example, the case is explained in which the switching control is determined to be continued when a reception state of a digital broadcast signal is equal to or less than the reception-state threshold TH, not limited thereto. Details thereof will be mentioned later with reference to FIG. 4.

Figure 2:
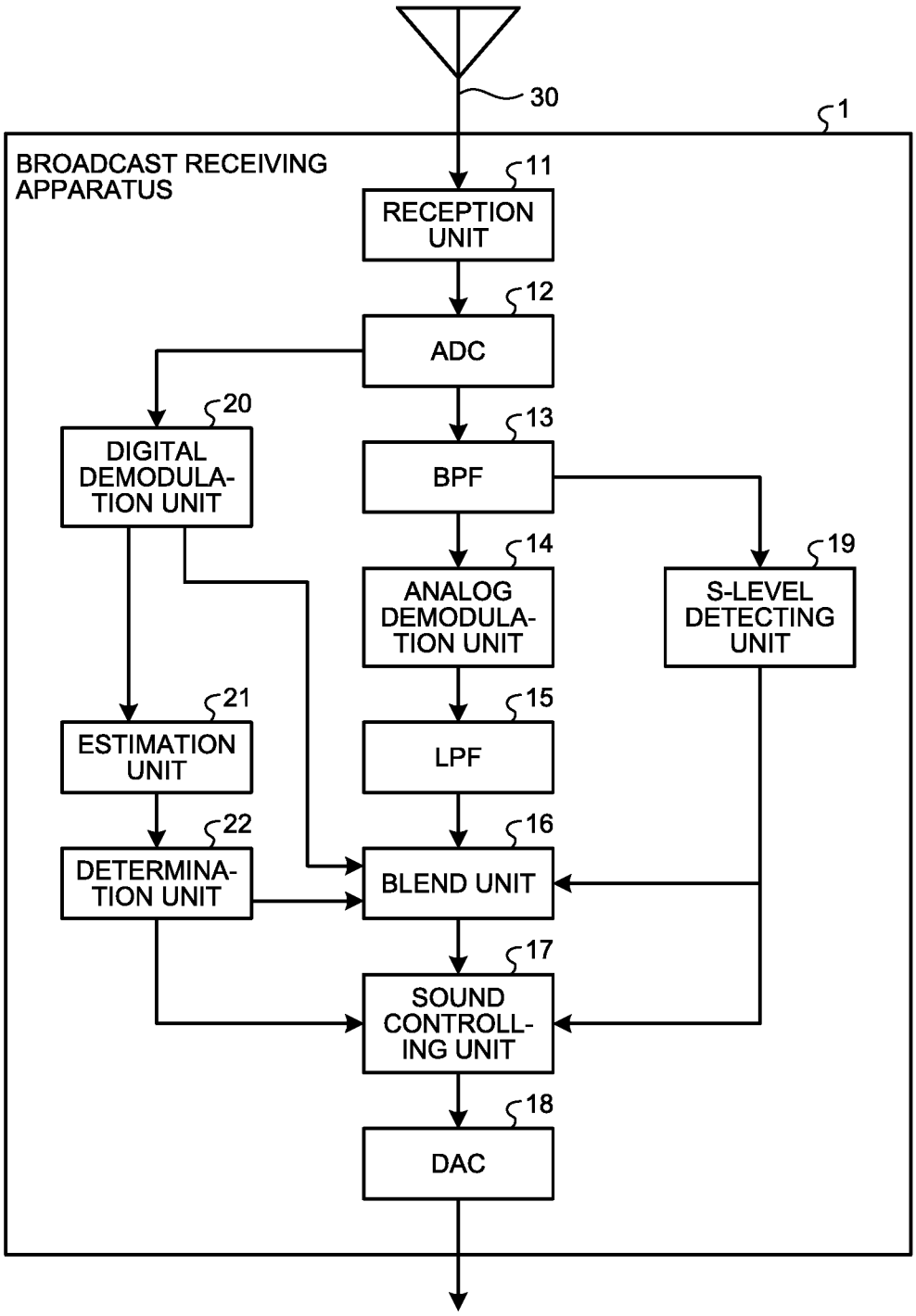
FIG. 2 is a block diagram illustrating a broadcast receiving apparatus.

Next, a configuration of a broadcast receiving apparatus 1 that performs the above broadcast receiving method will be explained with reference to FIG. 2. FIG. 2 is a block diagram illustrating the broadcast receiving apparatus 1.

As illustrated in FIG. 2, the broadcast receiving apparatus 1 according to the present embodiment includes a reception unit 11, an analog/digital converter (hereinafter, may be referred to as "ADC") 12, a bandpass filter (hereinafter, may be referred to as "BPF") 13, an analog demodulation unit 14, and a low-pass filter (hereinafter, may be referred to as "LPF") 15.

The broadcast receiving apparatus 1 includes a blend unit 16, a sound controlling unit 17, a digital/analog converter (hereinafter, may be referred to as "DAC") 18, a received-field-intensity detecting unit (hereinafter, may be referred to as "S-level detecting unit") 19, a digital demodulation unit 20, an estimation unit 21, and a determination unit 22.

The reception unit 11 receives, via an antenna 30, a digital broadcast and an analog broadcast having the same broadcast contents broadcasted in the IBOC system within a predetermined frequency band.

Specifically, the reception unit 11 receives, via the antenna 30, a broadcast signal broadcasted in a frequency band of a broadcast channel that is selected by an operation unit (not illustrated).

The reception unit 11 acquires, from the received broadcast signals, a digital broadcast signal used in the digital broadcast and an analog broadcast signal used in the analog broadcast, converts frequencies of the digital broadcast signal and the analog broadcast signal into intermediate frequencies, and outputs the intermediate frequencies to the ADC 12.

The ADC 12 converts the digital broadcast signal and the analog broadcast signal in analog format, which are input from the reception unit 11, into a digital broadcast signal and an analog broadcast signal in digital format. The ADC 12 outputs the converted digital broadcast signal to the digital demodulation unit 20 and outputs the converted analog broadcast signal to the BPF 13.

The digital demodulation unit 20 demodulates the digital broadcast signal input from the ADC 12. The digital demodulation unit 20 Orthogonal Frequency-Division Multiplexing (OFDM)-demodulates the OFDM-modulated digital-broadcast signal.

The digital demodulation unit 20 detects an error of a code in the OFDM-demodulated digital broadcast signal and performs error correction. The digital demodulation unit 20 outputs the error-corrected digital-broadcast signal to the blend unit 16.

The digital demodulation unit 20 calculates a Carrier-to-Noise ratio (C/N ratio) that indicates a reception state of the OFDM-demodulated digital-broadcast signal, and outputs the calculation result to the estimation unit 21.

The digital demodulation unit 20 may calculate a bit error rate or a modulation error ratio (namely, "MER") as a reception state of a digital broadcast signal.

The estimation unit 21 estimates a buffer continuation time interval of a digital broadcast on the basis of a history of the C/N ratio input from the digital demodulation unit 20, and predicts the necessity for switching of the broadcast from the digital broadcast into the analog broadcast on the basis of the estimated buffer continuation time interval.

The estimation unit 21 outputs the prediction result to the determination unit 22. The buffer continuation time interval indicates a time interval during which the broadcast receiving apparatus 1 consume a buffer of the digital broadcast.

The shorter is the buffer continuation time interval, the higher is the possibility of the broadcast for being switched from a digital broadcast into an analog broadcast in the near future. Thus, when the buffer continuation time interval is equal to or less than a threshold time interval THc to be mentioned later, the estimation unit 21 predicts that switching of a broadcast from a digital broadcast into an analog broadcast is needed.

The estimation unit 21 is assumed to estimate the buffer continuation time interval for each predetermined period (for example, 100 milliseconds). Details of the estimating process to be executed by the estimation unit 21 will be mentioned later with reference to FIGS. 3A and 3B.

A case will be explained in which the estimation unit 21 of the broadcast receiving apparatus 1 according to the embodiment estimates a buffer continuation time interval on the basis of a C/N ratio, however, the estimation unit 21 may estimate the buffer continuation time interval by using a bit error rate or a modulation error ratio.

The determination unit 22 determines whether or not the switching control performed by the sound controlling unit 17 is to be continued, on the basis of the prediction result input from the estimation unit 21, and outputs the determination result to the blend unit 16 and the sound controlling unit 17.

Specifically, when the estimation unit 21 predicts that switching of broadcast from a digital broadcast into an analog broadcast is needed after the sound controlling unit 17 started the switching control from the acoustic characteristic of the digital broadcast into the acoustic characteristic of the analog broadcast, the determination unit 22 determines to continue this switching control.

When the estimation unit 21 predicts that the switching from the digital broadcast into the analog broadcast is not needed, the sound controlling unit 17 interrupts the switching control from the acoustic characteristic of the digital broadcast into the acoustic characteristic of the analog broadcast, and outputs an instruction for recovering the acoustic characteristic to that of the digital broadcast. Details of the determination process to be executed by the determination unit 22 will be explained with reference to FIG. 4.

The BPF 13 removes, from an analog broadcast signal input from the ADC 12, a high-frequency component and a low-frequency component not to be used in the analog broadcast, and outputs, to the S-level detecting unit 19 and the analog demodulation unit 14, the analog broadcast signal from which the high-frequency and low-frequency components are removed.

The S-level detecting unit 19 detects the S-level of the analog broadcast signal input from the BPF 13, and outputs the detection result to the blend unit 16 and the sound controlling unit 17. The analog demodulation unit 14 demodulates the analog broadcast signal that is frequency-modulated or amplitude-modulated, and outputs the demodulated analog broadcast signal to the LPF 15.

The LPF 15 removes, from the analog broadcast signal input from the analog demodulation unit 14, a high-frequency component to be noise, and outputs, to the blend unit 16, the analog broadcast signal from which the high-frequency component to be noise is removed. The blend unit 16 mixes (blends) the digital broadcast signal input from the digital demodulation unit 20 and the analog broadcast signal input from the LPF 15 at an arbitrary mixture ratio, and outputs the mixed signal to the sound controlling unit 17.

For example, the blend unit 16 amplifies an output level of the digital broadcast signal by a predetermined variable "$\alpha$", and amplifies an output level of the analog broadcast signal by a variable "$1-\alpha$". The blend unit 16 executes a blending process on the amplified digital broadcast signal and the amplified analog broadcast signal, and outputs the blended signal to the sound controlling unit 17. The variable $\alpha$ is assumed to satisfy "$0 \leq \alpha \leq 1$".

When a C/N ratio of the digital broadcast signal is equal to or more than a blend threshold THd to be mentioned later, in other words, when a reception state of the digital broadcast signal is good, the blend unit 16 outputs only the digital broadcast signal by setting $\alpha$ to be one.

Next, in a case where a C/N ratio of the digital broadcast signal is less than the blend threshold THd when the blend unit 16 outputs only the digital broadcast signal, the blend unit 16 reduces α from one to zero by taking a predetermined time interval, and gradually changes the output to the analog broadcast.

In a case where the S-level input from the S-level detecting unit 19 rises to express the blend threshold THd when the blend unit 16 outputs only the analog broadcast signal, the blend unit 16 increases a from zero to one by taking a predetermined time interval, and gradually changes the output to the digital broadcast.

The sound controlling unit 17 changes acoustic characteristics of the digital broadcast signal and the analog broadcast signal input from the blend unit 16 and outputs them to the DAC 18.

The sound controlling unit 17 is constituted of a Digital Signal Processor (DSP), for example, and includes a band filter that changes frequency bands of the digital broadcast signal and the analog broadcast signal.

The acoustic characteristic is a frequency characteristic that indicates a relation between an output level and a frequency of any of the digital and analog broadcast signals. Hereinafter, an acoustic characteristic of a digital broadcast signal is referred to as "digital frequency response", and an acoustic characteristic of an analog broadcast signal is referred to as "analog frequency response".

The sound controlling unit 17 changes a cutoff frequency of the band filter so as to switch between the digital frequency response and the analog frequency response.

Specifically, at a timing in which an S-level input from the S-level detecting unit 19 is equal to or less than a start threshold THa when only the digital broadcast signal is output, the sound controlling unit 17 starts the switching control so that the digital frequency response approaches the analog frequency response.

The S-level of the start threshold THa is higher, by a predetermined level, than that of the analog broadcast when a reception state of the digital broadcast signal starts to deteriorate, for example. Therefore, the sound controlling unit 17 is able to start the switching control before the S-level of the digital broadcast signal is reduced. The start threshold THa is assumed to be preliminary calculated by simulation or statistics.

Next, the sound controlling unit 17 performs the switching control for bringing digital frequency response close to analog frequency response at a predetermined ratio. The predetermined ratio is a value that is set so that the switching control for bringing the digital frequency response close to the analog frequency response is completed during an interval in which the broadcast is switched from the digital broadcast into the analog broadcast.

In this manner, after starting the switching control, the sound controlling unit 17 performs the switching control at the predetermined ratio, regardless of the S-level of the analog broadcast signal. Thus, the switching control is not performed by following the S-level of the analog broadcast signal, unlike the conventional ones.

Therefore, it is possible to suppress a rapid change in the acoustic characteristic when the broadcast is switched from the digital broadcast into the analog broadcast, unlike the conventional ones. Details of a switching procedure of the digital frequency response performed by the sound controlling unit 17 will be explained when operations of the broadcast receiving apparatus 1 are to be explained with reference to FIG. 4.

The DAC 18 converts the digital broadcast signal and the analog broadcast signal in digital format that are input from the sound controlling unit 17 into a digital broadcast signal and an analog broadcast signal in analog format, and outputs them to a speaker (not illustrated).

Figure 3A:
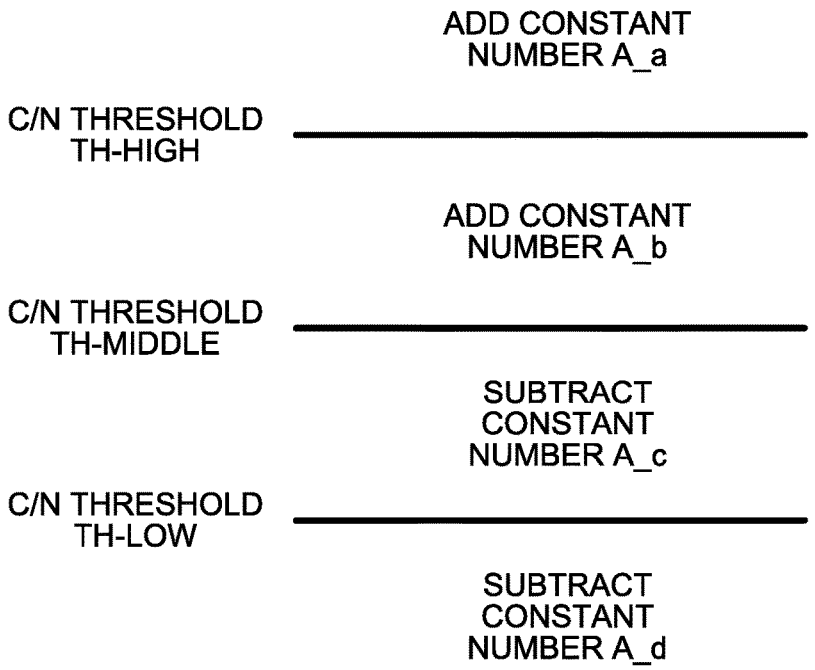
FIG. 3A is a diagram illustrating correlations between reception states of a digital broadcast and buffer continuation time intervals.
Figure 3B:
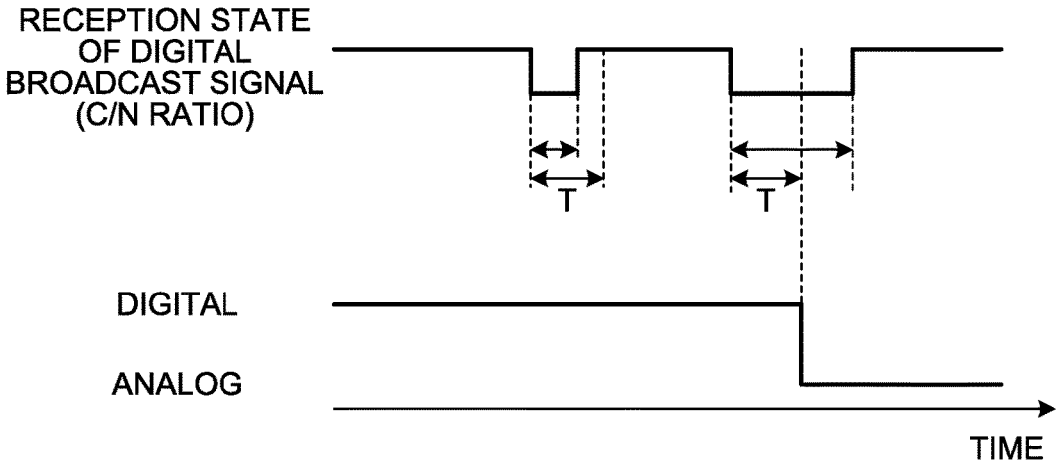
FIG. 3B is a diagram illustrating an estimating process to be executed by an estimation unit.

Next, the estimating process to be executed by the estimation unit 21 will be explained with reference to FIGS. 3A and 3B. FIG. 3A is a diagram illustrating correlations between C/N ratios of digital broadcast signals and buffer continuation time intervals. FIG. 3B is a diagram illustrating the estimating process to be executed by the estimation unit 21.

Quality of reception states of a digital broadcast is larger in the order of a C/N threshold TH-high>a C/N threshold TH-middle>a C/N threshold TH-low that are illustrated in FIG. 3A.

The constant numbers illustrated in FIG. 3A are assumed to satisfy relations of a constant number A_a>a constant number A_b and a constant number A_d>a constant number A_c. Appropriate values of correlation between the C/N thresholds and the constant numbers are preliminary developed by simulation, statistics, etc.

The estimation unit 21 adds or subtracts a constant number, which is different in accordance with a C/N ratio of a digital broadcast signal, to or from the present buffer continuation time interval with reference to a correlation table illustrated in FIG. 3A so as to estimate the newest buffer continuation time interval. In other words, the estimation unit 21 estimates the newest buffer continuation time interval on the basis of a history of the C/N ratio of the digital broadcast signal.

The information referred when the estimation unit 21 estimates a buffer continuation time interval is not limited to the correlation table illustrated in FIG. 3A, and may be an arithmetic function indicating a correspondence relation between reception states of a digital broadcast and a buffer continuation time interval.

When a C/N ratio of a digital broadcast signal input from the digital demodulation unit 20 is equal to or more than the C/N threshold TH-high, the estimation unit 21 adds the constant number A_a to the present buffer continuation time interval.

When a C/N ratio is less than the C/N threshold TH-high and equal to or more than the C/N threshold TH-middle, the estimation unit 21 adds the constant number A_b to the present buffer continuation time interval.

When a C/N ratio is less than the C/N threshold TH-middle and equal to or more than the C/N threshold TH-low, the estimation unit 21 subtracts the constant number A_c from the present buffer continuation time interval. Moreover, when a C/N ratio is less than the C/N threshold TH-low, the estimation unit 21 subtracts the constant number A_d from the present buffer continuation time interval.

In this manner, when a C/N ratio of a digital broadcast signal is good, the estimation unit 21 adds a constant number to a buffer continuation time interval, when a C/N ratio is in a deteriorated state, the estimation unit 21 subtracts a constant number.

In other words, in a case where a reception state is good, a buffer amount of stored digital broadcast increases even when a digital broadcast is output, the broadcast receiving apparatus 1 according to the embodiment increases a buffer continuation time interval.

In a state where a reception state is worse, the broadcast receiving apparatus 1 discharges the buffer of stored digital broadcast to output a digital broadcast, and reduces a buffer continuation time interval.

The estimation unit 21 may estimate the buffer continuation time interval by using, multiplication, division, or another arithmetic function, not limited to addition and multiplication.

The estimation unit 21 predicts the necessity for switching of a broadcast from a digital broadcast into an analog broadcast on the basis of the estimated newest buffer continuation time interval. Specifically, when a buffer continuation time interval is equal to or less than the threshold time interval THc, the estimation unit 21 predicts that switching of a broadcast from a digital broadcast into an analog broadcast is needed.

The threshold time interval THc is, for example, 0.5 seconds, not limited thereto, an appropriate value may be developed by statistics, simulation, etc.

In this manner, the estimation unit 21 predicts the necessity for switching between the broadcasts on the basis of the buffer continuation time interval, when worsening of a C/N ratio of a digital broadcast is instantaneous, the estimation unit 21 predicts no need for switching between the broadcasts.

This is because, when worsening of a C/N ratio of a digital broadcast is instantaneous, a digital broadcast signal is able to be restored by an error correction. Specifically, as illustrated in FIG. 3B, when a C/N ratio of a digital broadcast signal recovers during a predetermined time interval T, the digital broadcast signal of the interval whose C/N ratio is reduced is restored by the digital demodulation unit 20.

Thus, the necessity for switching of a broadcast from a digital broadcast into an analog broadcast is low. When an interval, in which a C/N ratio of a digital broadcast signal is reduced, exceeds the predetermined time interval T during which a digital broadcast signal is able to be restored by an error correction, a digital broadcast signal is not restored. Thus, the necessity for switching of a broadcast from a digital broadcast into an analog broadcast is high.

In this manner, the estimation unit 21 predicts the necessity for switching between the broadcasts on the basis of a buffer continuation time interval, it is possible to predict switching of a broadcast from a digital broadcast into an analog broadcast with high accuracy.

The determination unit 22 performs the determination on the basis of this prediction, when an interval, in which a C/N ratio is reduced, is within the predetermined time interval T, the determination unit 22 determines that the switching control performed by the sound controlling unit 17 from digital frequency response into analog frequency response is not to be continued.

Therefore, it is possible to prevent the sound controlling unit 17 from uselessly switching the frequency response from digital frequency response into analog frequency response. The determination unit 22 may directly acquire a C/N ratio without via the digital demodulation unit 20 and the estimation unit 21, and may determine, when a time interval in which this C/N ratio is deteriorated is within the predetermined time interval T, that the switching control for switching the acoustic characteristic from an acoustic characteristic of a digital broadcast into an acoustic characteristic of an analog broadcast is not to be continued.

Next, operations of the broadcast receiving apparatus 1 according to the present embodiment for switching between an analog broadcast and a digital broadcast will be explained with reference to FIG. 4. FIG. 4 is a diagram illustrating switching operations to be performed by the broadcast receiving apparatus 1.

Figure 4:
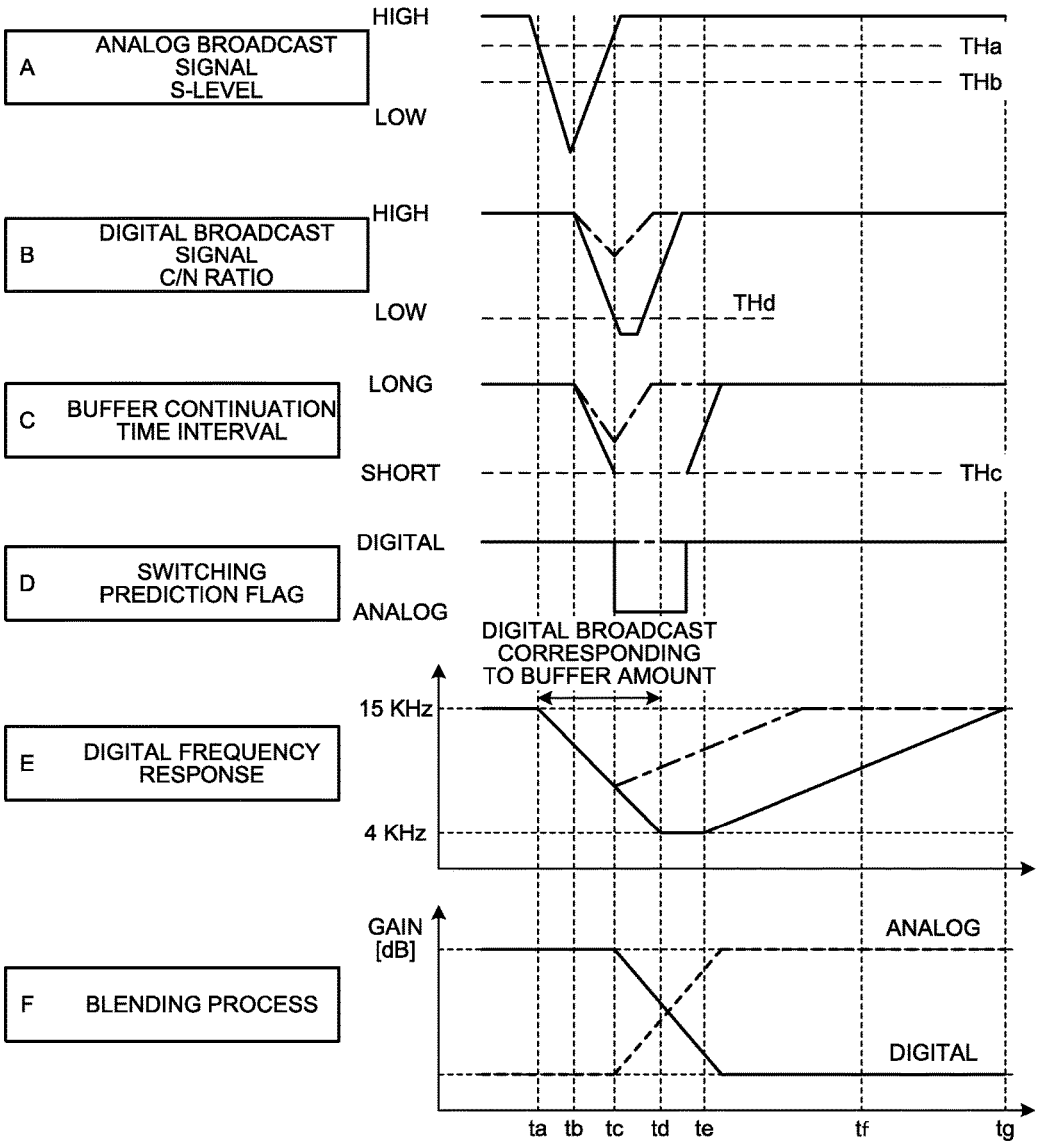
FIG. 4 is a diagram illustrating switching operations to be performed by the broadcast receiving apparatus.

"A" illustrated in FIG. 4 indicates transition of an S-level of an analog broadcast signal detected by the S-level detecting unit 19, and "B" illustrated in FIG. 4 indicates transition of a C/N ratio of a digital broadcast signal calculated by the digital demodulation unit 20.

"C" illustrated in FIG. 4 indicates a buffer continuation time interval estimated by the estimation unit 21, and "D" illustrated in FIG. 4 indicates a prediction result of switching between a digital broadcast and an analog broadcast performed by the estimation unit 21.

"E" illustrated in FIG. 4 indicates transition of the switching control over digital frequency response performed by the sound controlling unit 17, and "F" illustrated in FIG. 4 indicates transition of the blending process performed by the blend unit 16. In "F" illustrated in FIG. 4, output level (gain) of a digital broadcast is indicated by solid lines, and gain of an analog broadcast is indicated by dashed lines.

As indicated by "A" illustrated in FIG. 4, in a case where an S-level detected by the S-level detecting unit 19 when a digital broadcast is output is higher than the start threshold THa, as indicated by "E" illustrated in FIG. 4, the sound controlling unit 17 sets the digital frequency response to be 15 kHz (hereinafter, may be referred to as "digital broadcast frequency response"), which is for a digital broadcast, for example.

As indicated by "A" illustrated in FIG. 4, in a case where an S-level becomes equal to or less than the start threshold THa at a time point ta when a digital broadcast is output, the sound controlling unit 17 attenuates digital frequency response at a predetermined ratio from the time point ta so as to start the switching control for bringing the digital frequency response close to, for example, 4 kHz (hereinafter, may be referred to as "analog broadcast frequency response"), which is for an analog broadcast.

The sound controlling unit 17 sequentially sets cutoff frequencies in a band filter so as to attenuate the digital frequency response from digital broadcast frequency response to analog broadcast frequency response at a predetermined ratio.

Next, as indicated by "B" illustrated in FIG. 4, the C/N ratio of the digital broadcast signal is start to deteriorate from a time point tb, as indicated by "C" illustrated in FIG. 4, a buffer continuation time interval estimated by the estimation unit 21 is start to reduce.

As indicated by "D" illustrated in FIG. 4, at a time point tc when the buffer continuation time interval is equal to or less than the threshold time interval TH, the estimation unit 21 predicts that the necessity for switching of the broadcast from the digital broadcast into the analog broadcast is high, and inverts a switching prediction flag from the digital broadcast into the analog broadcast.

The determination unit 22 determines at the time point tc, on the basis of the prediction result of the estimation unit 21, the switching control performed by the sound controlling unit 17 is to be continued. Thus, as indicated by "E" illustrated in FIG. 4, the sound controlling unit 17 is to perform the switching control for switching to the analog broadcast frequency response by taking a time period until a time point td.

As indicated by "B" illustrated in FIG. 4, the C/N ratio of the digital broadcast signal is reduced to be lower than the blend threshold THd at the time point tc. Thus, as indicated by "F" illustrated in FIG. 4, the blend unit 16 starts the blending process for attenuating a gain of the digital broadcast and raising a gain of the analog broadcast.

For the blend threshold THd, a C/N ratio value of the digital broadcast signal when the S-level is reduced from the start threshold THa by a predetermined level is set, for example. Thus, the sound controlling unit 17 starts the switching control before the blend unit 16 starts the blending process, in other words, switching between the broadcasts.

As indicated by "F" illustrated in FIG. 4, the case in which the blend unit 16 starts the blending process at a time point Tc when the C/N ratio is reduced to be lower than the blend threshold THd, not limited thereto. The blend unit 16 may start the blending process from a time point Td when the switching control performed by the sound controlling unit 17 is completed, for example.

In this case, the blending process by the blend unit 16 and the switching control by the sound controlling unit 17 are not executed in parallel with each other, so that it is possible to reduce processing load of a controller 10.

As indicated by "E" illustrated in FIG. 4, the sound controlling unit 17 performs the switching control for switching the frequency response from the digital frequency response into the analog broadcast frequency response by using the digital broadcast corresponding to the buffer amount stored in the broadcast receiving apparatus 1 at the time point ta, for example.

In this manner, even when a C/N ratio of a digital broadcast signal rapidly becomes worse not to decode a digital broadcast signal at all from then on, the sound controlling unit 17 is able to normally complete the switching control of the digital frequency response. Thus, it is possible to prevent the acoustic characteristic from rapidly changing at a timing of switching between the broadcasts.

The sound controlling unit 17 may change a ratio for attenuating the digital frequency response in accordance with a buffer continuation time interval at the time point to when the S-level of the analog broadcast signal is equal to or less than the start threshold THa.

On the other hand, as indicated by "C" illustrated in FIG. 4 by using dashed lines after the time point tb, when a buffer continuation time interval is not equal to or less than the threshold time interval THc, the estimation unit 21 predicts that the necessity for switching of the broadcast from the digital broadcast into the analog broadcast is low. Therefore, in this case, as indicated by "D" illustrated in FIG. 4 by using dashed lines, the estimation unit 21 holds a switching prediction flag to be a digital broadcast.

The determination unit 22 determines, by receiving the prediction, that the switching control performed by the sound controlling unit 17 is not to be continued. In this case, the determination unit 22 causes the sound controlling unit 17 to interrupt the switching control, and instructs the sound controlling unit 17 to recover the digital frequency response up to the digital broadcast frequency response again.

As indicated by "E" illustrated in FIG. 4 by using dashed lines, the sound controlling unit 17 raises again, from the time point tc, the digital frequency response up to 15 kHz that corresponds to digital broadcast frequency response.

In this case, as indicated by "B" illustrated in FIG. 4, the C/N ratio of the digital broadcast signal is not equal to or less than the blend threshold THd, whereby the blend unit 16 does not execute the blending process and only the digital broadcast is output.

Thus, it is possible to suppress a process for uselessly reducing the digital frequency response by the sound controlling unit 17. In other words, useless reduction in an acoustic digital ratio is able to be suppressed, so that it is possible to provide good sounds to a user. In this case, the determination unit 22 instructs the blend unit 16 to execute the blending process for amplifying an output level of the digital broadcast signal.

When terminating the switching control for switching the frequency response from the digital frequency response into the analog broadcast frequency response, the sound controlling unit 17 performs the switching control for gradually bringing the digital frequency response, which is set to be the analog broadcast frequency response on the basis of the S-level of the analog broadcast signal, close to the digital broadcast frequency response.

For example, when the S-level exceeds a switching threshold THb indicated by "A" illustrated in FIG. 4, the sound controlling unit 17 starts the switching control for raising the digital frequency response up to the digital broadcast frequency response so as to perform the switching control until a time point tg.

The switching threshold THb is assumed to be set, by statistics or simulation, to be a value of an S-level for which a buffer continuation time interval estimated by the estimation unit 21 is equal to or more than a predetermined value. As indicated by "A" illustrated in FIG. 4, a value of the switching threshold THb is lower than that of the start threshold THa, however, a value of the switching threshold THb may be equal to that of the start threshold THa, or may be equal to or more than the start threshold THa.

In this case, the blend unit 16 executes the blending process for amplifying a gain of a digital broadcast after the sound controlling unit 17 starts the switching control so as to attenuate a gain of an analog broadcast, for example (not illustrated).

In this case, the blend unit 16 may execute the above blending process after the sound controlling unit 17 terminates the switching control for switching into the digital broadcast frequency response, alternatively, the blend unit 16 may start the blending process in advance of the switching control to be performed by the sound controlling unit 17.

When performing the switching control from the digital broadcast frequency response into the analog broadcast frequency response, the sound controlling unit 17 performs the switching control by taking a time interval that is longer than that when the switching control from the analog broadcast frequency response into the digital broadcast frequency response is performed.

Specifically, the sound controlling unit 17 is configured to set an interval between time points to and tg for switching into the digital broadcast frequency response, which is indicated by "E" illustrated in FIG. 4, to be longer than that between the time points to and td for switching into the analog broadcast frequency response.

This is because, when the broadcast is switched from the digital broadcast into the analog broadcast, a buffer continuation time interval of the digital broadcast is reduced, and thus there exists a limit to a time interval to be taken by the switching control.

When the broadcast is switched from the analog broadcast into the digital broadcast, the switching is performed in a state where a buffer continuation time interval is sufficient for the switching control, and thus the switching control is able to be performed by taking a long time interval.

Thus, the sound controlling unit 17 is able to perform the switching control from the analog broadcast frequency response into the digital broadcast frequency response more smoothly. Thus, it is possible to more reduce unpleasant feeling in human hearing sense to be provided to a user.

Not limited to the aforementioned example, when performing the switching control from the analog broadcast frequency response into the digital broadcast frequency response, the sound controlling unit 17 may perform the switching control having a time interval similar to that of a case where the switching control from the digital broadcast frequency response into the analog broadcast frequency response is performed. In this case, it is possible to improve the acoustic digital ratio.

As indicated by "E" illustrated in FIG. 4, the case is illustrated in which the sound controlling unit 17 performs the switching control over the digital frequency response by using the ratio proportional to a time point, not limited thereto. For example, the sound controlling unit 17 may perform the switching control over the digital frequency response by using a ratio not proportional to a time point.

Figure 5:
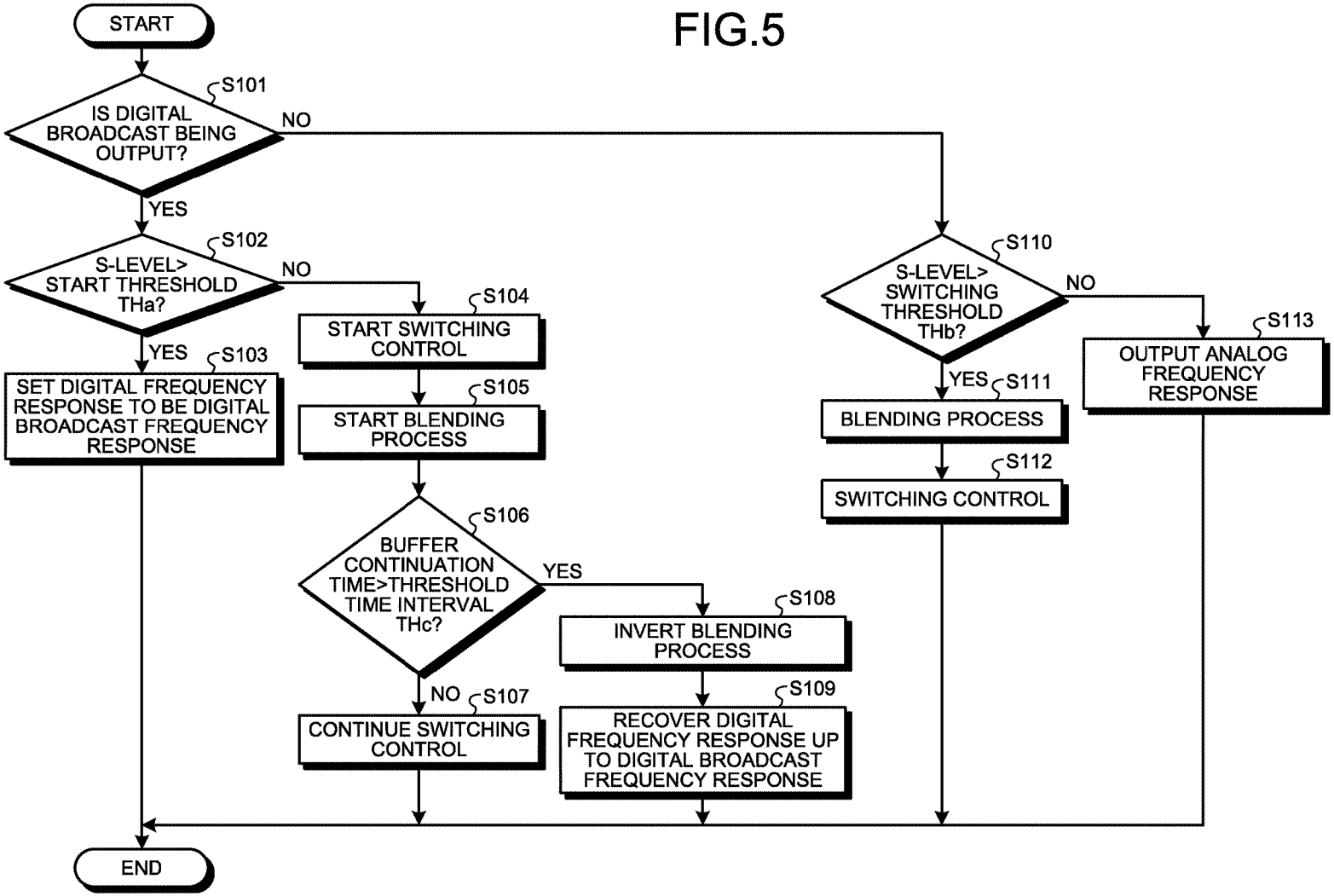
FIG. 5 is a flowchart illustrating a procedure for processes to be executed by the broadcast receiving apparatus.

Next, a processing procedure to be executed by the broadcast receiving apparatus 1 according to the present embodiment will be explained with reference to FIG. 5. FIG. 5 is a flowchart illustrating a procedure for processes to be executed by the broadcast receiving apparatus 1. The following processes are repeatedly executed by the broadcast receiving apparatus 1.

As illustrated in FIG. 5, first, the broadcast receiving apparatus 1 determines whether or not a digital broadcast is being output (Step S101). When determining that a digital broadcast is being output (Step S101: Yes), the broadcast receiving apparatus 1 determines whether or not the S-level of the analog broadcast signal is higher than the start threshold THa (Step S102).

When determining that an S-level is higher than the start threshold THa (Step S102: Yes), the broadcast receiving apparatus 1 sets the digital frequency response to be the digital broadcast frequency response (Step S103), and terminates the process.

On the other hand, when determining that the S-level is equal to or less than the start threshold THa (Step S102: No), the broadcast receiving apparatus 1 starts the switching control so that the digital frequency response approaches the analog broadcast frequency response (Step S104). Next, when the S-level is less than the blend threshold THd, the broadcast receiving apparatus 1 starts the blending process for reducing an output level of the digital broadcast and increasing an output level of the analog broadcast (Step S105).

Next, the broadcast receiving apparatus 1 determines whether or not the buffer continuation time interval is longer than the threshold time interval THc (Step S106). When determining that the buffer continuation time interval is equal to or less than the threshold time interval THc (Step S106: No), the broadcast receiving apparatus 1 continues the switching control (Step S107), and terminates the process.

When determining that the buffer continuation time interval is longer than the threshold time interval THc (Step S106: Yes), the broadcast receiving apparatus 1 inverts the blending process (Step S108). The broadcast receiving apparatus 1 recovers the digital broadcast frequency response up to the digital frequency response (Step S109), and terminates the process.

On the other hand, when determining that the digital broadcast is not being output (Step S101: No), the outputting broadcast is the analog broadcast, and thus the broadcast receiving apparatus 1 determines whether or not the S-level is higher than the switching threshold THb (Step S110).

When determining that the S-level is higher than the switching threshold (Step S110: Yes), the broadcast receiving apparatus 1 executes the blending process for amplifying the output level of the digital broadcast and attenuating the output level of the analog broadcast (Step S111).

The broadcast receiving apparatus 1 performs the switching control for switching the digital frequency response into the analog frequency response (Step S112), and terminates the process. The broadcast receiving apparatus 1 may execute Step S112 in advance of Step S111.

On the other hand, when the S-level is lower than the switching threshold THb (Step S110: No), the broadcast receiving apparatus 1 outputs the analog frequency response (Step S113), and terminates the process.

As described above, the broadcast receiving apparatus 1 according to the present embodiment includes the reception unit 11, the sound controlling unit 17, and the determination unit 22. The reception unit 11 receives a signal of an analog broadcast and a signal of a digital broadcast having the same broadcast content. The sound controlling unit 17 performs, when the digital broadcast is switched to the analog broadcast, a switching control of switching the digital broadcast into the analog broadcast so that an acoustic characteristic of the digital broadcast gradually approaches an acoustic characteristic of the analog broadcast on the basis of a reception intensity of the signal of the analog broadcast received by the reception unit 11. The determination unit 22 determines, when the sound controlling unit 17 starts the switching control, whether or not the switching control performed by the sound controlling unit 17 is to be continued, on the basis of a reception state of the signal of the digital broadcast received by the reception unit 11. Therefore, by employing the broadcast receiving apparatus 1 according to the present embodiment, it is possible to improve accuracy in the switching control over the acoustic characteristic.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A broadcast receiving apparatus comprising:

a processor programmed to:

receive a signal of an analog broadcast and a signal of a digital broadcast having a same broadcast content;

perform, when an output of the broadcast receiving apparatus is switched into the analog broadcast from the digital broadcast, a switching control of switching into an acoustic characteristic of the analog broadcast from an acoustic characteristic of the digital broadcast so that the acoustic characteristic of the output digital broadcast gradually approaches the acoustic characteristic of the analog broadcast based on a reception intensity of the received signal of the analog broadcast; and determine, after the switching control is started and in a middle of gradual switching from the acoustic characteristic of the digital broadcast to the acoustic characteristic of the analog broadcast, whether or not the started switching control is to be continued, based on a reception state of the received signal of the digital broadcast.

2. The broadcast receiving apparatus according to claim 1, wherein the processor is further programmed to perform, when the reception intensity of the signal of the analog broadcast is equal to or less than a predetermined start threshold, the switching control, regardless of the subsequent reception intensity, such that the acoustic characteristic of the digital broadcast gradually approaches the acoustic characteristic of the analog broadcast at a predetermined ratio.

3. The broadcast receiving apparatus according to claim 1, wherein the processor is further programmed to determine, in a case where the switching control of switching from the acoustic characteristic of the digital broadcast into the acoustic characteristic of the analog broadcast is started and then the reception state of the signal of the digital broadcast recovers within a predetermined time interval, that the switching control is not to be continued, and determine, in a case where the reception state does not recover within the predetermined time interval, that the switching control is to be continued.

4. The broadcast receiving apparatus according to claim 1, wherein the processor is further programmed to:

estimate a buffer continuation time interval of the digital broadcast based on a history of the reception state of the signal of the digital broadcast, and determine, in a case where the switching control of switching from the acoustic characteristic of the digital broadcast into the acoustic characteristic of the analog broadcast is started and then the estimated buffer continuation time interval is equal to or more than a predetermined threshold time interval, that the switching control is not to be continued, and determine, in a case where the buffer continuation time interval is within the threshold time interval, that the switching control is to be continued.

5. The broadcast receiving apparatus according to claim 1, wherein the processor is further programmed to perform, when performing the switching control of switching from the acoustic characteristic of the digital broadcast into the acoustic characteristic of the analog broadcast, the switching control by taking a time interval that is longer than a time interval for performing a switching control for switching from the acoustic characteristic of the analog broadcast into the acoustic characteristic of the digital broadcast.

6. A broadcast receiving method comprising:

receiving a signal of an analog broadcast and a signal of a digital broadcast having a same broadcast content;

performing, when an output of a broadcast receiving apparatus is switched into the analog broadcast from the digital broadcast, a switching control of switching into an acoustic characteristic of the analog broadcast from an acoustic characteristic of the digital broadcast so that the acoustic characteristic of the output digital broadcast gradually approaches the acoustic characteristic of the analog broadcast based on a reception intensity of the received signal of the analog broadcast; and determining, after the switching control is started and in a middle of gradual switching from the acoustic characteristic of the digital broadcast to the acoustic characteristic of the analog broadcast, whether or not the started switching control is to be continued, based on a reception state of the received signal of the digital broadcast.

7. The broadcast receiving method according to claim 6, wherein the performing of the switching control includes performing, when the reception intensity of the signal of the analog broadcast is equal to or less than a predetermined start threshold, the switching control, regardless of the subsequent reception intensity, such that the acoustic characteristic of the digital broadcast gradually approaches the acoustic characteristic of the analog broadcast at a predetermined ratio.

8. The broadcast receiving method according to claim 6, wherein the determining includes determining, in a case where the switching control from the acoustic characteristic of the digital broadcast into the acoustic characteristic of the analog broadcast is started and then the reception state of the signal of the digital broadcast recovers within a predetermined time interval, that the switching control is not to be continued, and determining, in a case where the reception state does not recover within the predetermined time interval, that the switching control is to be continued.

9. The broadcast receiving method according to claim 6, further comprising: estimating a buffer continuation time interval of the digital broadcast based on a history of the reception state of the signal of the digital broadcast, wherein the determining includes determining, in a case where the switching control from the acoustic characteristic of the digital broadcast into the acoustic characteristic of the analog broadcast is started and then the estimated buffer continuation time interval is equal to or more than a predetermined threshold time interval, that the switching control is not to be continued and determining in a case where the buffer continuation time interval is within the threshold time interval that the switching control is to be continued.

10. The broadcast receiving method according to claim 6, wherein the performing of the switching control includes performing, when performing the switching control from the acoustic characteristic of the digital broadcast into the acoustic characteristic of the analog broadcast, the switching control by taking a time interval that is longer than a time interval for performing a switching control for switching from the acoustic characteristic of the analog broadcast into the acoustic characteristic of the digital broadcast.

* * * * *